US008587287B2

(12) United States Patent
Larsen et al.

(10) Patent No.: US 8,587,287 B2
(45) Date of Patent: Nov. 19, 2013

(54) HIGH-BANDWIDTH LINEAR CURRENT MIRROR

(75) Inventors: Christian Larsen, Irvine, CA (US); Lorenzo Crespi, Costa Mesa, CA (US)

(73) Assignee: Conexant Systems, Inc., Irvine, CA (US)

( * ) Notice: Subject to any disclaimer, the term of this patent is extended or adjusted under 35 U.S.C. 154(b) by 540 days.

(21) Appl. No.: 12/828,640

(22) Filed: Jul. 1, 2010

(65) Prior Publication Data

US 2012/0001613 A1 Jan. 5, 2012

(51) Int. Cl.
*G05F 3/16* (2006.01)

(52) U.S. Cl.
USPC ..... 323/315

(58) Field of Classification Search
USPC ..... 323/311, 312, 315, 316
See application file for complete search history.

(56) References Cited

U.S. PATENT DOCUMENTS

| | | | | |
|---|---|---|---|---|
| 4,446,419 | A * | 5/1984 | van de Plassche et al. | 323/316 |
| 4,714,872 | A * | 12/1987 | Traa | 323/314 |
| 4,965,510 | A * | 10/1990 | Kriedt et al. | 323/315 |
| 6,166,670 | A * | 12/2000 | O'Shaughnessy | 341/136 |
| 6,501,256 | B1 * | 12/2002 | Jaussi et al. | 323/315 |
| 6,570,371 | B1 * | 5/2003 | Volk | 323/315 |
| 6,844,772 | B2 * | 1/2005 | Hoon et al. | 327/541 |
| 6,897,717 | B1 * | 5/2005 | Eddleman et al. | 327/543 |
| 7,541,862 | B2 * | 6/2009 | Fujisawa et al. | 327/539 |
| 7,626,374 | B2 * | 12/2009 | Haiplik | 323/313 |
| 7,724,092 | B2 * | 5/2010 | Quan et al. | 330/288 |
| 7,948,319 | B2 * | 5/2011 | Mukophadhyay et al. | 330/288 |
| 2005/0237105 | A1 * | 10/2005 | Park | 327/539 |
| 2009/0066313 | A1 * | 3/2009 | Kimura | 323/313 |

OTHER PUBLICATIONS

Sedighi, Behnam, et al.; Variable Gain Current Mirror for High-Speed Applications; IEICE Electronics Express, vol. 4, No. 8, 277-281, Apr. 25, 2007.

* cited by examiner

*Primary Examiner* — Adolf Berhane
(74) *Attorney, Agent, or Firm* — Jackson Walker L.L.P.; Christopher J. Rourk

(57) ABSTRACT

High linearity is essential in audio circuitry. As sampling rates for audio applications are needed, high speed and high linearity are needed in analog and mixed signal portions of audio circuitry such as in current mirrors. A current mirror employs two current paths in an output. The first current path is driven by a fast acting transistor through a resistor. The second current path is driven by a differential amplifier coupled to another transistor through another resistor. The second current path is used to maintain linearity by causing the voltage across both transistors to be the same.

20 Claims, 9 Drawing Sheets

HIGH-BANDWIDTH LINEAR CURRENT MIRROR

TECHNICAL FIELD

This invention relates to generally to the semiconductor circuits and specifically with current mirrors.

BACKGROUND ART

A current mirror is a basic building block of circuitry, particularly in current-mode circuits. A current mirror receives a current and generates a matching current. A current mirror has a wide variety of applications including digital to analog converter (DAC), automatic gain control, tunable time filter, etc.

FIG. 1 shows a basic current mirror. It comprises field effect transistor (FET) 102 which has its drain and gate coupled together and FET 104 which has its gate coupled to the gate of FET 102. When current flows through FET 102 the voltage registered at the gate of FET 102 controls the current through FET 104 to a matching current to that flowing through FET 102. As a result, the input current $I_{REF}$. is mirrored at output node 106 by output current $I_{MIRROR}$. Current mirrors are can also be constructed from bipolar junction transistors (BJTs) in a similar fashion.

SUMMARY OF INVENTION

A high speed highly linear current mirror is disclosed. The high speed current mirror comprises a transistor and a resistor in series in an input path. Two parallel output paths provide an output current through another resistor. A transistor coupled to the transistor in the input path controls one output path. Another transistor coupled to a differential amplifier controls the other output path. The differential amplifier measures the voltage difference between the two resistors and causes the voltage across the two resistors to be the same.

In one embodiment, the transistors are FETs. In another embodiment, the transistors are bipolar junction transistors (BJTs) having a high β. In other embodiments, one or both of the resistors are variable resistors. In another embodiment both resistors have the same resistance. In yet another embodiment, the differential amplifier is an operational amplifier.

One application of the high speed current mirror is a single ended DAC for use in audio applications. The DAC comprises a differential current steering DAC, an differential amplifier, such as an operational amplifier, a resistor and the high speed current mirror. The current mirror mirrors one of the outputs of the current steering DAC so that the difference between the outputs of the current steering DAC can be drawn through the resistor to produce a voltage signal. This voltage signal can then be used in an audio driver comprising a single-ended amplifier receiving the voltage signal and an output driver.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

A detailed description of embodiments of the present invention is presented below. While the disclosure will be described in connection with these drawings, there is no intent to limit it to the embodiment or embodiments disclosed herein. On the contrary, the intent is to cover all alternatives, modifications and equivalents included within the spirit and scope of the disclosure as defined by the appended claims.

Figure 2:
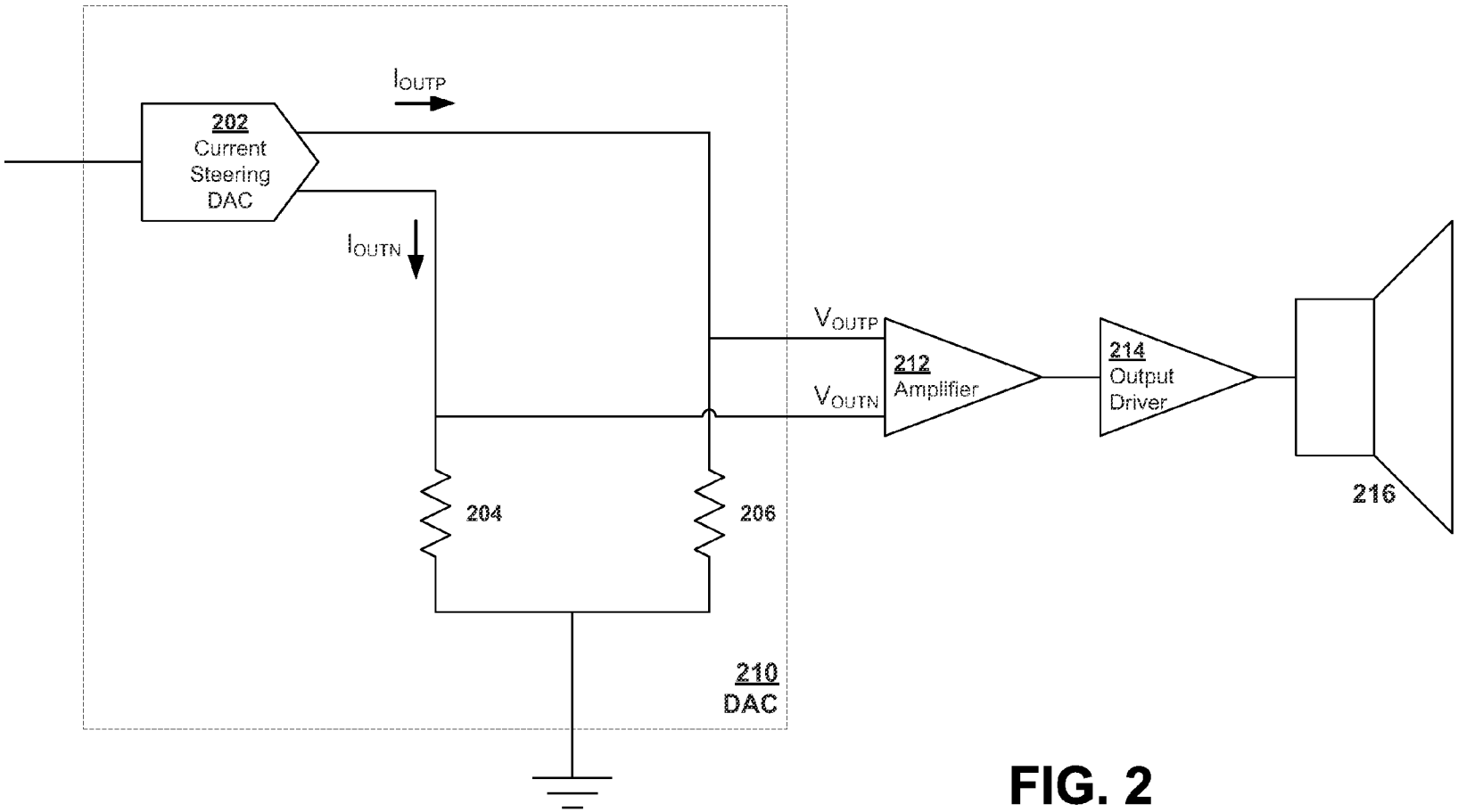
FIG. 2 shows an embodiment of the mixed signal and analog portions of an audio driver.

FIG. 2 shows an embodiment of the mixed signal and analog portions of an audio driver. The audio driver comprises DAC 210, amplifier 212 and output driver 214. DAC 210 differentially drives amplifier 212 and output driver 214 drives speaker 216. The connection between amplifier 212 and output driver 214 can be single ended or differential, as can the connection between output driver 214 and speaker 216. As shown in this example, the driver has a two stage analog portion but in some embodiments, this can be one stage or three stage configuration. DAC 210 comprises current steering DAC 202 and resistors 204 and 206. Current steering DACs are widely available and have become a common building block in mixed signal circuits due to their performance and availability. Resistor 204 receives current $I_{OUTN}$ and provides output voltage $V_{OUTN}$ and resistor 206 receives current $I_{OUTP}$ and provides output voltage $V_{OUTP}$. Thus the resistors provide a differential voltage output for DAC 210. While the conversion of the differential current output of current steering DAC 202 to a differential voltage is straight forward. It is more complex to use a current steering DAC to provide a single ended output.

Figure 3:
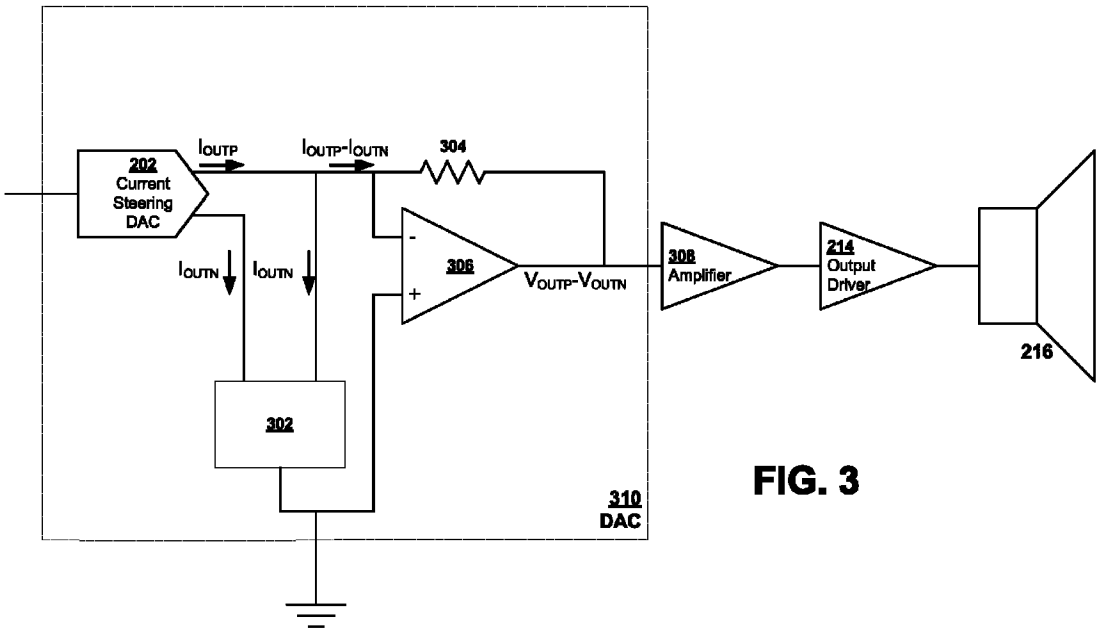
FIG. 3 shows an embodiment of the mixed signal and analog portions of an audio driver.

FIG. 3 shows another embodiment of the mixed signal and analog portions of an audio driver. The audio driver comprises DAC 310, amplifier 308, and output driver 214. DAC 310 provides a single output to single-ended amplifier 308. The connection between amplifier 308 and output driver 214 can be single ended or differential, as can the connection between output driver 214 and speaker 216. As shown in this example, the driver has a two stage analog portion, but in some embodiments this can be one stage or three stage among other configurations.

DAC 310 is comprised of current steering DAC 202, current mirror 302, resistor 304, and a differential amplifier shown here as operational amplifier 306. Current mirror 302 draws $I_{OUTN}$ from $I_{OUTP}$, so that the net current flow through resistor 304 is $I_{OUTP}-I_{OUTN}$. Thus, the voltage across resistor 304 is $V_{OUTP}-V_{OUTN}$ and operational amplifier stably forces one terminal of the resistor at ground while permitting the other terminal which is coupled to DAC 310's output to take the value of $V_{OUTP}-V_{OUTN}$.

Figure 1:
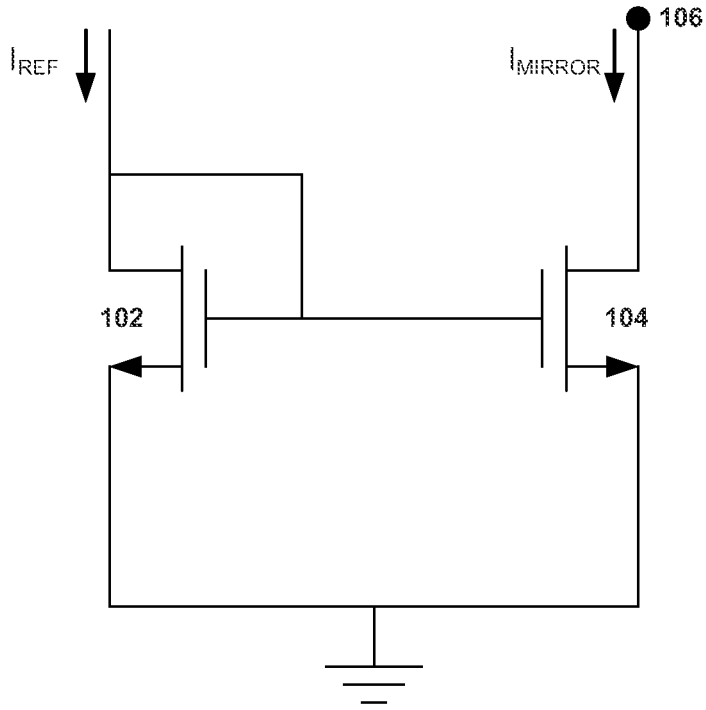
FIG. 1 shows a basic current mirror.

As audio drivers operate at faster sampling rates, greater demands are placed on components within DAC 310. For example, it becomes desirable for current mirror 302 to react very quickly to changes in the current. The basic current mirror shown in FIG. 1 can adapt quickly to changes in input current, but at the expense of the linearity of the current mirror. In other words, the voltage seen at the terminal of current mirror is not linearly proportional to the current drawn. Non-linearity in audio circuits often equate to distortion experienced by the listener. Therefore, a fast moving linear current mirror is highly desirable in any audio circuit using a current mirror, but in particular, the DAC within an audio driver.

Figure 4:
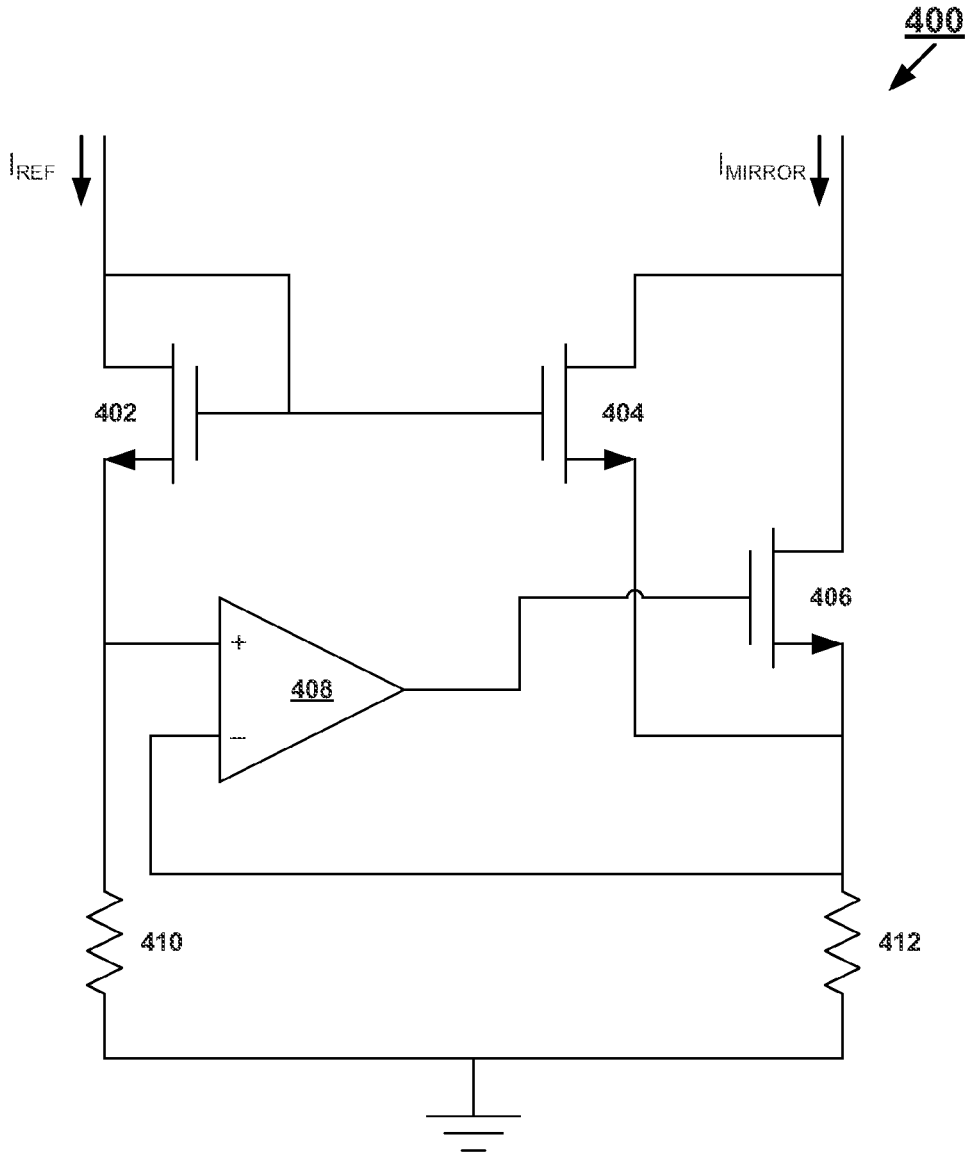
FIG. 4 shows an embodiment of a current mirror.

FIG. 4 shows an embodiment of a current mirror. The current mirror comprises FET 402, FET 404, FET 406, a differential amplifier shown here as operational amplifier 408, resistor 410, and resistor 412. Resistors 410 and 412 can have the same resistance. FET 402 and FET 404 are configured as traditional current mirrors. Operational amplifier 408 compares the voltages across resistors 410 and resistors 412. In this configuration, the current mirrored is the combined current flowing through FET 404 and FET 406.

However, the current drawn through FET 404 is susceptible to error. The fast path of the current mirror is fabricated so that FET 404 is smaller than FET 402. The result is that FET 404 has a higher impedance than FET 402, so rather than precisely mirroring the current flowing through FET 402, the current flowing through FET 404 is a current proportional and smaller than the current flowing through FET 402. For example, if the impedance of FET 402 is 90% that of FET 404, the current flowing through FET 404 would be 90% that of FET 402. Other ratios can be employed but for most applications a ratio between 80-90% is effective. As a design criteria, the ratio should be sufficient to prevent current flowing through FET 404 to exceed that of FET 402 with error taken into account. For example, if the ratio is 90% then an error of 10% is tolerated.

Operational amplifier 408 measures the difference in voltages across resistor 412 and resistor 410. It generates a voltage proportional to the difference causing FET 406 to pass current until the voltage across resistor 412 matches that across resistor 410. Because FET 404 and FET 406 are in a parallel arrangement, the total current passing through FET 404 and FET 406 passes through resistor 412. This current is the total current drawn by the current mirror. If resistors 410 and 412 have the same resistance, the current $I_{MIRROR}$ drawn through resistor 412 would be substantially the same as the current $I_{REF}$ flowing through resistor 410 in order to have the same voltage across the two resistors. The bulk of the current is drawn by fast acting FET 404 but operational amplifier 408, resistors 410 and 412 use FET 406 to maintain linearity. In the absence of FET 404, the circuit would still perform as a current mirror. However, operational amplifiers are often slow acting and such a current mirror would not be suitable for high speed applications.

Figure 5:
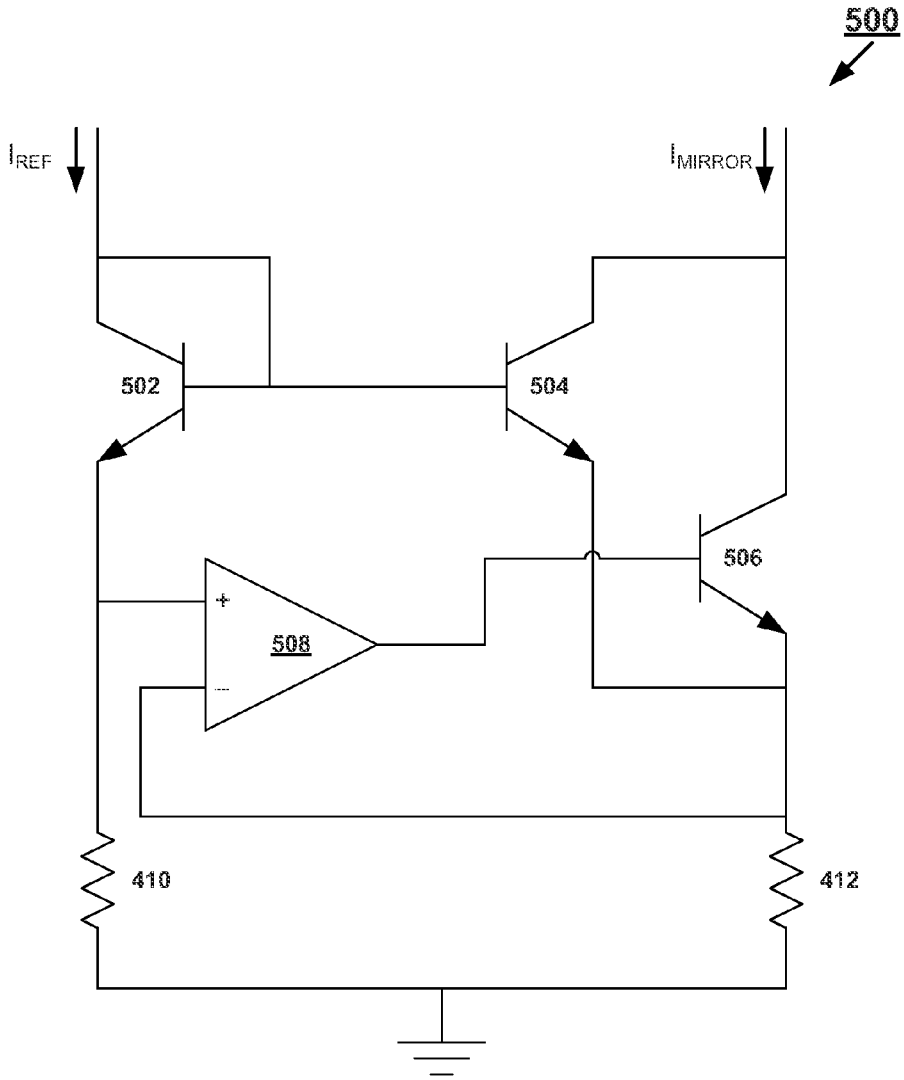
FIG. 5 illustrates an analogous current mirror constructed using BJTs.

FIG. 5 illustrates an analogous current mirror constructed using BJTs. It comprises BJT 502, BJT 504, BJT 506, a differential amplifier shown here as operational amplifier 508, resistor 410 and resistor 412. Current mirror 500 is similar in basic functionality to current mirror 400. However, the physics are quite different. Chief among the differences is that BJTs use current into and out of the base to control current flowing from the collector to the emitter. If significant current flows between the bases of BJT 402 and BJT 404, linearity is not maintained. However, if the BJTs are selected with a high β value, the current flowing through this path is negligible.

Figure 6:
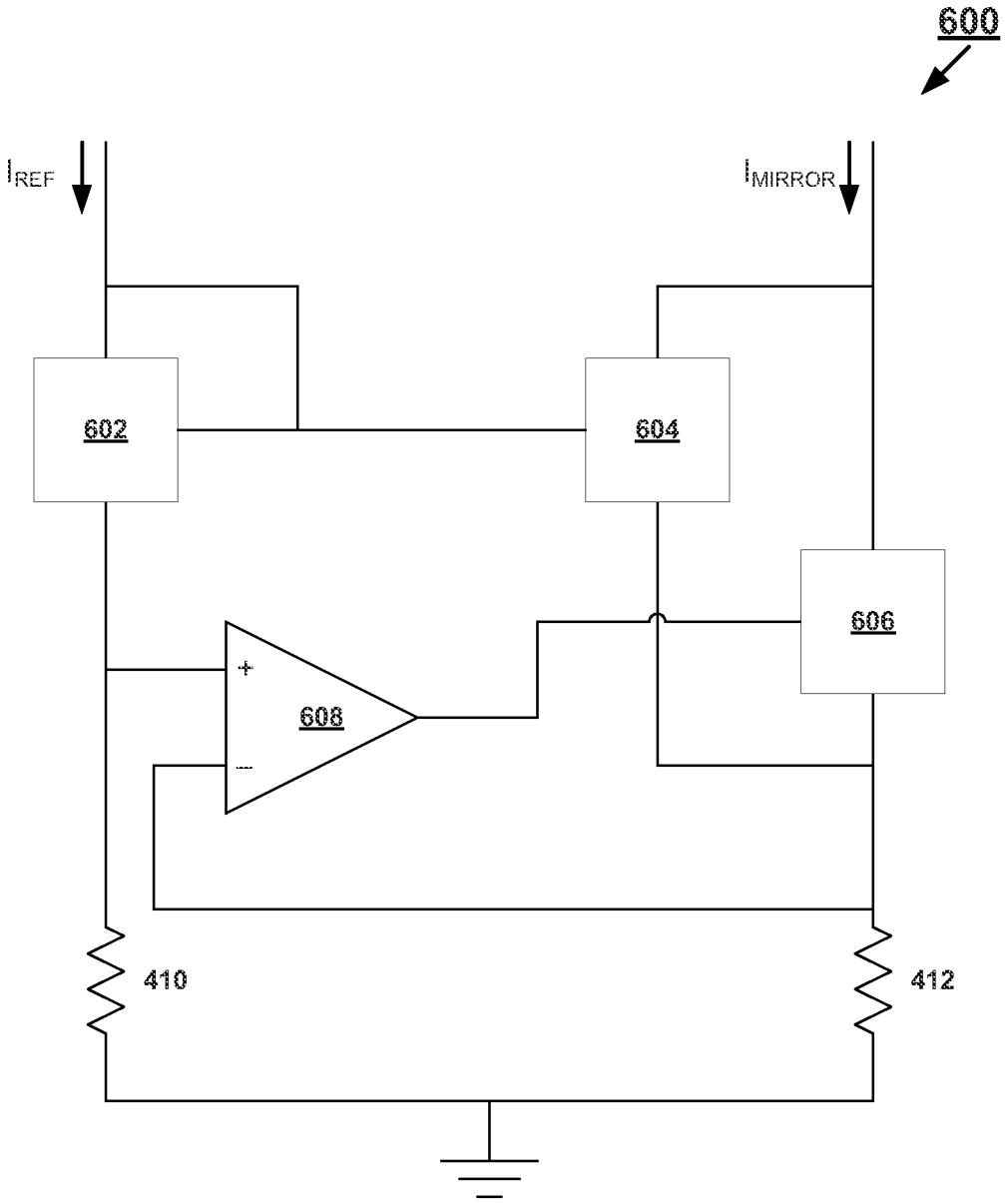
FIG. 6 illustrates a current mirror with generic transistors.

Because FET and BJT fail to exhibit common terminology, for the purposes of describing a generic current mirror. The term control terminal should refer to the base of a BJT or the gate of an FET. The term input terminal should refer to the collector of a BJT or the drain of an FET. The term output terminal should refer to the emitter of a BJT or the source of an FET. With this terminology in place, FIG. 6 illustrates a current mirror with generic transistors. Current mirror 600 comprises transistor 602, transistor 604, transistor 606, a differential amplifier shown here as operational amplifier 608, resistor 410 and resistor 412. In one embodiment, transistors 602, 604 and 606 are FETs and hence current mirror 600 becomes current mirror 400. In another embodiment, transistors 602, 604, and 606 are BJTs and hence current mirror 600 becomes current mirror 500.

Figure 7:
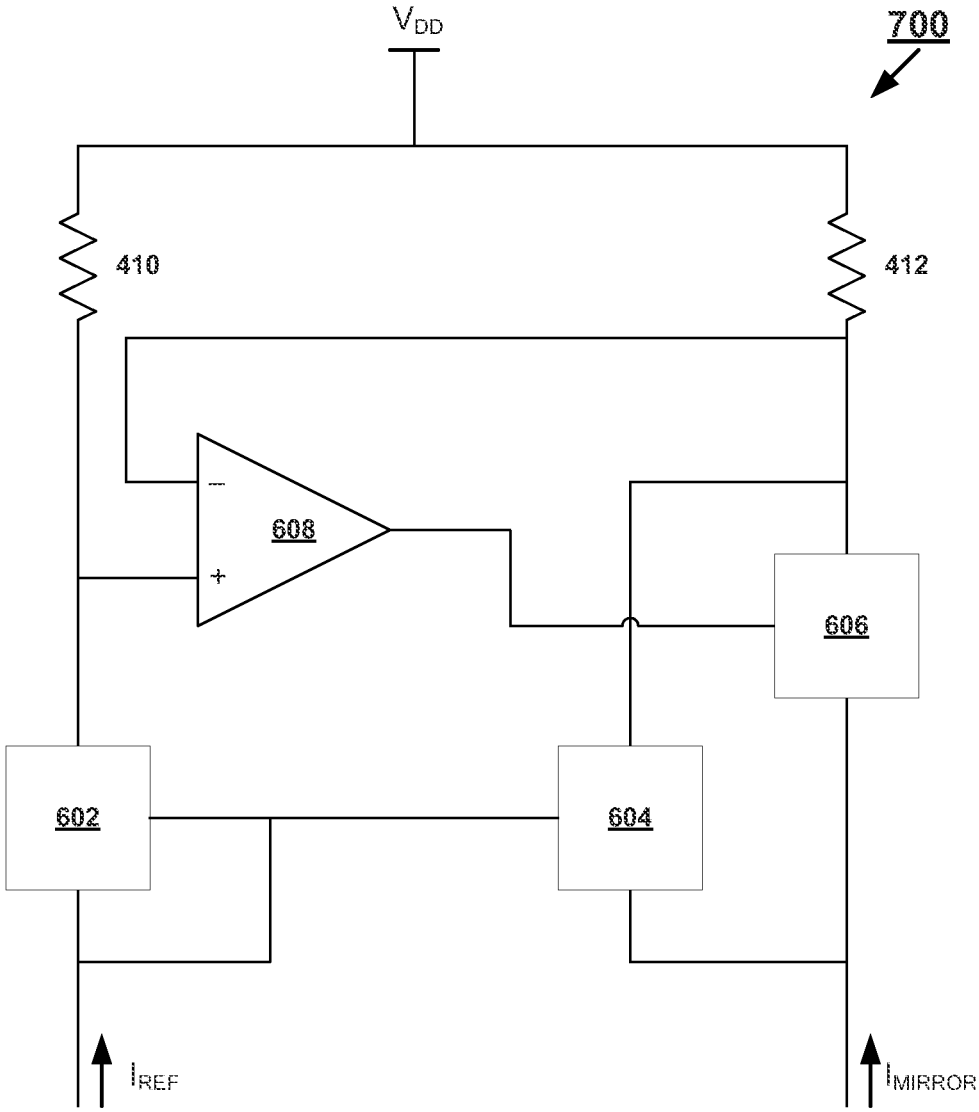
FIG. 7 shows an embodiment of a sourcing current mirror.

It should be noted that in the previous examples, the resistors are coupled to a reference voltage which is shown to ground. The current mirror also operates when the reference voltage is tied to another voltage level. As shown in FIG. 7, when the reference voltage is the positive supply rail, the direction of current flow is reversed. Instead of a sinking current mirror, current mirror 700 is a sourcing current mirror. Structurally, current mirror 600 and 700 are topologically the same, though current mirror 700 is now drawn upside down to adhere the convention of having the positive supply on top. However, current mirror 700 uses the positive supply rail rather than ground.

Current mirrors 400, 500, 600, and 700 maintain linearity even when resistors 410 and 412 do not have the same resistances. Rather than functioning as a unity gain current mirror, the effect is the current mirror functions with a gain proportional of the ratio of resistor 410 to resistor 412. For example, if the resistance of resistor 410 is twice that of resistor 412, the current mirror would have a gain of 2.

The gain of the current mirror could be made adjustable, by replacing either resistor 410 and/or resistor 412 with a variable resistor. By adjusting the resistance of the variable resistor, the gain of the current mirror could be adjusted.

Figure 8:
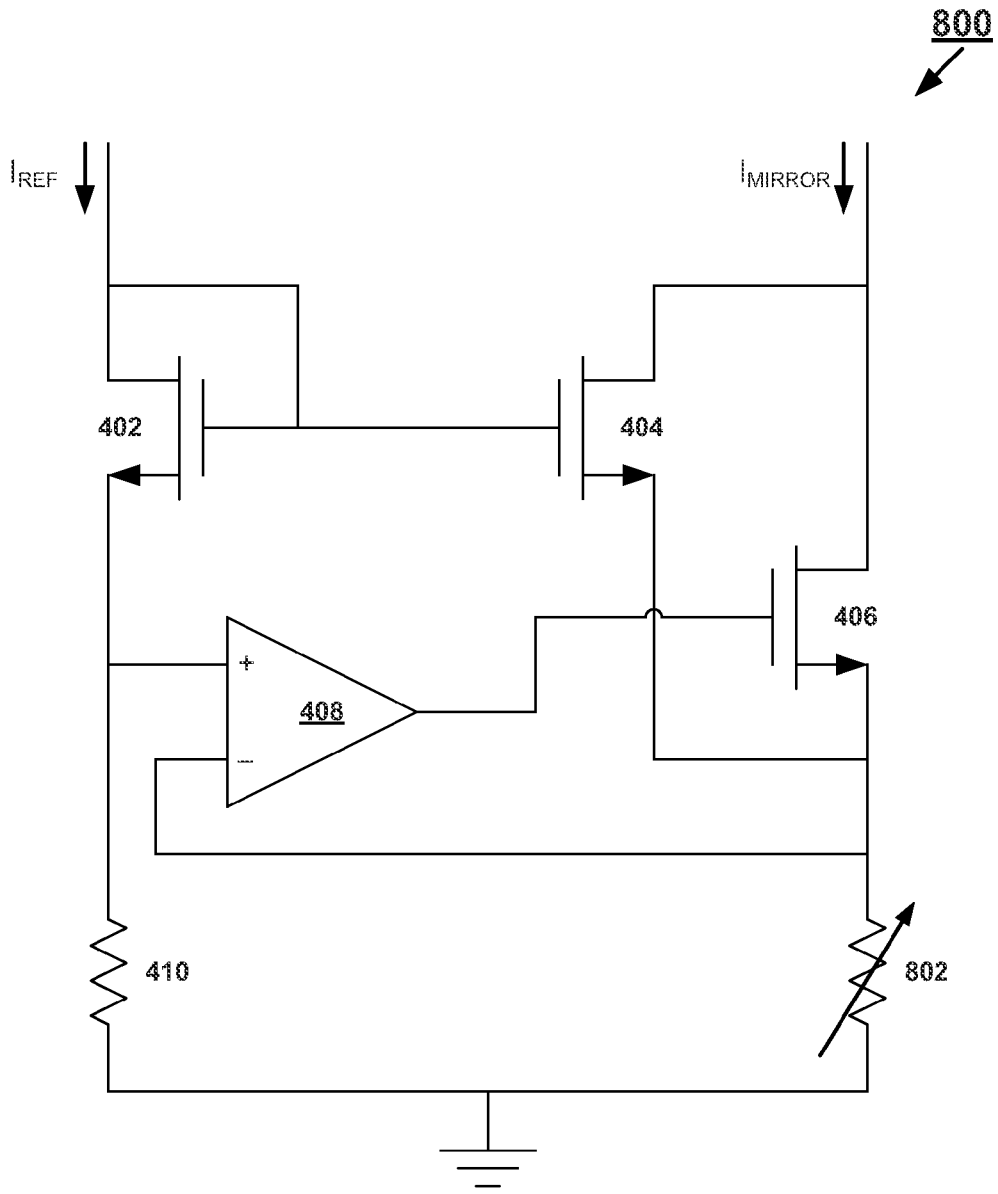
FIG. 8 shows a variable gain embodiment of the current mirror.

FIG. 8 shows a variable gain embodiment of the current mirror 800. It is similar to current mirror 400 but comprises variable resistor 802 instead of resistor 412. By adjusting the resistance of variable resistor 802, the gain can be adjusted. The gain is inversely proportional to the resistance of variable resistor 802.

Figure 9:
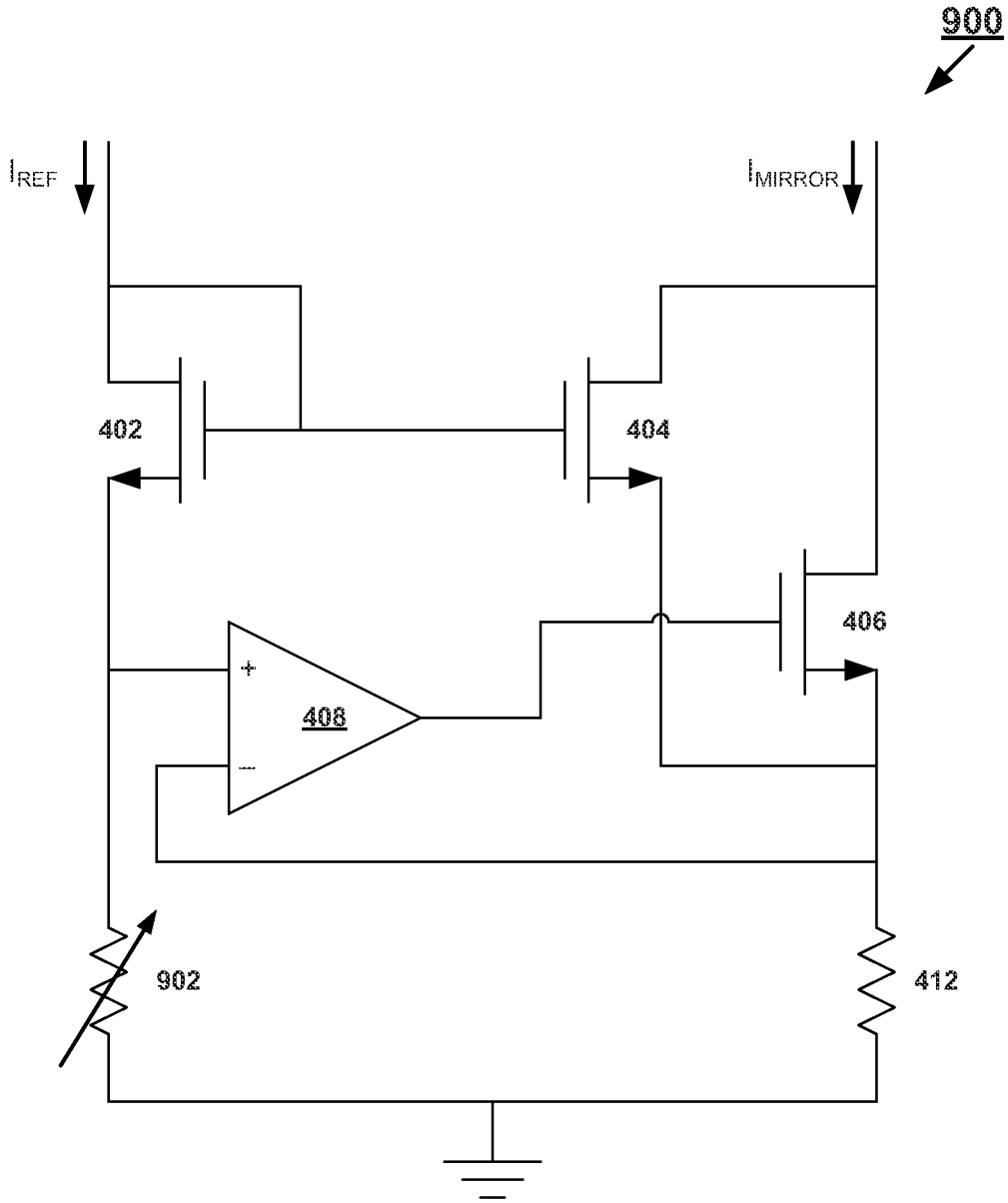
FIG. 9 shows an alternate variable gain embodiment of the current mirror.

FIG. 9 shows an alternate variable gain embodiment of the current mirror. Current mirror 900 is similar to current mirror 400 but comprises variable resistor 902 instead of resistor 410. By adjusting the resistance of variable resistor 902, the gain can be adjusted. The gain is proportional to the resistance of resistor 902. The choice of using current mirror 800 or 900 depends on the type of adjustment to the gain that is desired.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed:

1. A circuit comprising:

a first transistor operable to receive an input current;

a first resistor in series with the first transistor operable to receive input current;

a second resistor operable to receive an output current;

a differential amplifier operable to compare a first voltage measured across the first resistor and a second voltage measured across the second resistor;

a second transistor responsive to the first transistor controlling a first current;

a third transistor responsive to the differential amplifier controlling a second current;

wherein the second transistor and third transistor are configured in parallel and the output current comprises the first current and the second current.

2. The circuit of claim 1, wherein the first transistor, second transistor and third transistor are field effect transistors.

3. The circuit of claim 1, wherein the first transistor, second transistor and third transistors are bipolar junction transistors having a high β.

4. The circuit of claim 1, wherein the first resistor is a variable resistor.

5. The circuit of claim 1, wherein the second resistor is a variable resistor.

6. The circuit of claim 1, wherein the first resistor and the second resistor both have resistances that are substantially equal.

7. The circuit of claim 1, wherein the differential amplifier is an operational amplifier.

8. The circuit of claim 1, further comprising:

a current steering DAC;

an operational amplifier;

a third resistor;

wherein the current steering DAC is coupled to the first transistor and the second transistor is coupled to the third resistor and the operational amplifier.

9. The circuit of claim 8, further comprising:

a single-ended amplifier; and an output driver.

10. A circuit comprising:

a current steering DAC;

a means for controlling a first current on the basis of the input current;

a means for controlling a second current on the basis of comparing the input current with an output current, further comprising:

an operational amplifier; and a resistor; and wherein the output current comprises the first current and the second current, and the current steering DAC is coupled to a first transistor and a second transistor is coupled to the resistor and the operational amplifier.

11. The method of claim 10 wherein the means for controlling the second current comprises:

a means for comparing a first voltage across a first resistor operable to receiving the input current with a second voltage across a second resistor operable to receive the output current.

12. The circuit of claim 10, further comprising:

a single-ended amplifier; and an output driver.

13. A circuit comprising:

a first transistor operable to receive an input current;

a first resistor in series with the first transistor operable to receive input current;

a second resistor operable to receive an output current;

a differential amplifier operable to compare a first voltage measured across the first resistor and a second voltage measured across the second resistor;

a second transistor responsive to the first transistor controlling a first current;

a third transistor responsive to the differential amplifier controlling a second current;

wherein the second transistor and third transistor are configured in parallel and the output current comprises the first current and the second current, the first transistor, second transistor and third transistor are field effect transistors, and the first resistor is a variable resistor.

14. The circuit of claim 13, wherein the second resistor is a variable resistor.

15. The circuit of claim 13, wherein the first resistor and the second resistor both have resistances that are substantially equal.

16. The circuit of claim 13, wherein the differential amplifier is an operational amplifier.

17. The circuit of claim 13, further comprising:

a current steering DAC; and an operational amplifier.

18. The circuit of claim 17, further comprising:

a third resistor; and wherein the current steering DAC is coupled to the first transistor and the second transistor is coupled to the third resistor and the operational amplifier.

19. The circuit of claim 18, further comprising:

a single-ended amplifier; and an output driver.

20. The circuit of claim 13, wherein the second resistor is a variable resistor and the differential amplifier is an operational amplifier.

* * * * *